United States Patent [19]

Kondo et al.

[11] 4,398,070

[45] Aug. 9, 1983

[54] TWO-MOTION PUSH-BUTTON SWITCH

[75] Inventors: Shiro Kondo, Furukawa; Ken Mizuta, Miyagi, both of Japan

[73] Assignee: Alps Electric Co., Ltd., Tokyo, Japan

[21] Appl. No.: 333,786

[22] Filed: Dec. 23, 1981

[30] Foreign Application Priority Data

Dec. 24, 1980 [JP] Japan ..... 55-185812[U]

[51] Int. Cl.[3] ..... H01H 15/02; H01H 21/00

[52] U.S. Cl. ..... 200/16 R; 200/1 B; 200/67 DB

[58] Field of Search ..... 200/5 R, 16 R, 67 DA, 200/67 DB, 153 LA, 159 A, 153 K, 1 B, 160

[56] References Cited

U.S. PATENT DOCUMENTS

| | | | |
|---|---|---|---|
| 2,923,787 | 2/1960 | Nelson | 200/67 DB |
| 3,873,078 | 3/1975 | Wolf | 200/67 DB X |
| 3,898,402 | 8/1975 | Ford | 200/67 DB |
| 3,899,648 | 8/1975 | Murata | 200/5 R |
| 4,002,871 | 1/1977 | Sims, Jr. | 200/159 A |
| 4,002,879 | 1/1977 | Sims, Jr. | 200/159 A |
| 4,186,290 | 1/1980 | Matsuo | 200/159 A |
| 4,249,055 | 2/1981 | Matsuo | 200/67 DB X |

*Primary Examiner*—J. R. Scott

*Attorney, Agent, or Firm*—Guy W. Shoup; Gerard F. Dunne

[57] ABSTRACT

Disclosed is a two-motion push-button switch which comprises first and second switch portions, each switch portion including a movable contact piece 4 or 6 formed of an elastic thin metal plate and having a reversing portion provided with a movable contact portion and arms formed to grip the reversing portion therebetween and fixed contact portions *2a,3a* or *8a,9a* formed in a case 1 or 7 at the position confronting said movable contact portion, and one slider 5 slidably arranged in the case, wherein the movable contact pieces are reversed by said slider to drive said two switch portions so that the reversing force of the moving contact piece of the first switch portion is made different from that of the movable contact piece of the second switch portion.

3 Claims, 5 Drawing Figures

TWO-MOTION PUSH-BUTTON SWITCH

BACKGROUND OF THE INVENTION (1) Field of the Invention

The present invention relates to a push-button switch. More specifically, the present invention relates to a push-button switch of the momentary motion type in which the thickness of the switch is reduced, a light switching touch is obtained and two-motion changeover operation is possible.

(2) Description of the Prior Art

A two-motion push-button switch is used for various purposes. For example, it is used in a tape recorder or the like to perform the switching operation of the running speed of the tape to move the tape at an ordinary speed or a higher speed, and in adjusting the indicating hands of an electric clock, the two-motion push-button switch is used for performing the switching operation of the rotation speed and turning the hands at a higher speed. Furthermore, the two-motion push-button switch is combined with an electric circuit and is used as a pulse-generating switch.

Various push-button switches of this type differing in structure have heretofore been proposed. However, these switches typically have a complicated structure and are often large in their dimensions. In the field of electronic appliances such as radio sets and television sets, diversification of the functions, reduction of the size and enhancement of the quality and capacity have been desired, and development of a push-button switch of this type which is reduced in the size and can be operated by a small driving force with a good operation touch is desired.

SUMMARY OF THE INVENTION

The present invention is to provide a two-motion push-button switch meeting the above requirement. More specifically, in accordance with the present invention, there is provided a two-motion push-button switch of a simple structure in which movable contact pieces formed by a thin, electrically conductive metal plate high in resiliency are arranged in parallel to construct reversing spring contact pieces exerting a pressing action in the direction parallel to the planes thereof, a light switching operation touch is given by the reversing motion of the reversing spring contact pieces, and the pressing force of one reversing spring contact is made different from that of the other movable contact piece so that changeover is possible between two motions.

The present invention will now be described in detail with reference to the accompanying drawings illustrating one embodiment of the present invention.

DETAILED DESCRIPTION OF THE PREFERRED EMBODIMENT

Figure 1:
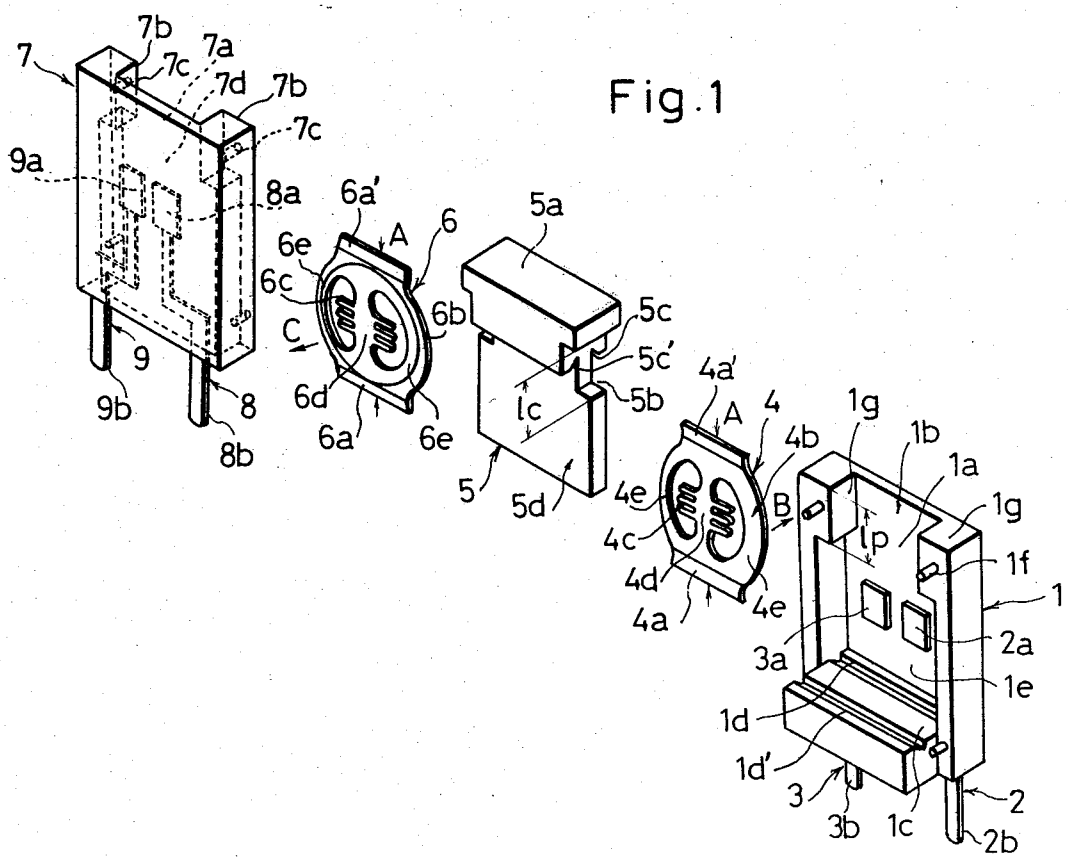
FIG. 1 is a fragmentary perspective view illustrating one embodiment of the two-motion push-button switch according to the present invention.
Figure 2:
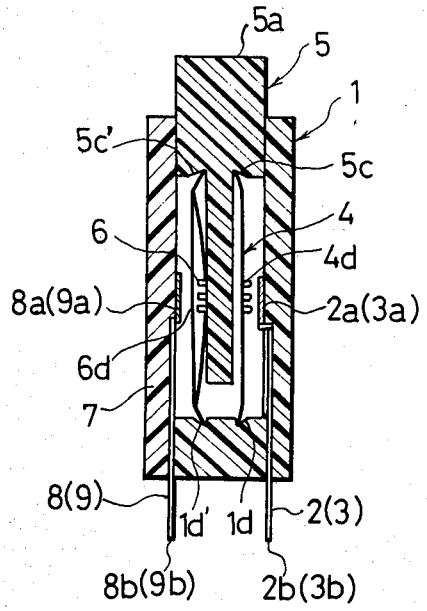
FIG. 2 is a sectional side view of the push-button switch shown in FIG. 1.
Figure 3A:
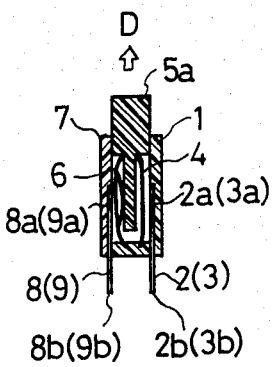
FIGS. 3-(*a*) to 3-(*c*) are sectional side views illustrating the operations of the push-button switch shown in FIG. 1.
Figure 3B:
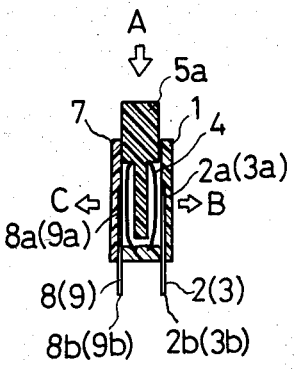
Figure 3C:
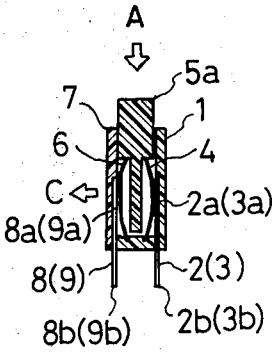

Referring to the drawings in which FIG. 1 is a fragmentary perspective view showing the structure of the push-button switch of the present invention, FIG. 2 is a sectional view of the push-button switch of the present invention and FIG. 3 is a diagram illustrating the operations of the push-button switch of the present invention, a first case 1 is molded from a synthetic resin and comprises an open concave portion 1*a*, an opening 1*b* formed in the upper side wall shown in FIG. 1 and a side wall 1*c* confronting said opening 1*b* and projecting outward at a right angle from a bottom 1*e*. Grooves 1*d* and 1*d'* having a V-shaped section are formed on the side wall 1*c*, and poles 1*f* are formed at the four corners of the side walls for attachment of a second case described hereinafter. In the bottom of the concave portion 1*a* are fixed contact pieces 2 and 3 providing fixed contacts 2*a* and 3*a'* and external connection terminals 2*b* and 3*b* connected to the fixed contacts extend from the surface of the bottom 1*e* of the case 1. Incidentally, the fixed contact pieces 2 and 3 are fixed to the case simultaneously with the molding of the case by arranging the contact pieces in a mold and insert-molding a synthetic resin in the mold. A movable contact piece 4 forming a movable contact of a first switch portion is integrally formed from a thin, electrically conductive metal plate high in resiliency, and the movable contact piece 4 comprises a pair of arms 4*a* and 4*a'* formed on respective ends of the contact pieces and a bent portion 4*b* held between the arms 4*a* and 4*a'*. A part of the bent portion 4*b* is punched to comprise a movable contact portion 4*d* divided with a plurality of segments and having tongue pieces 4*c* formed by bending the contact portion 4*d* in the direction B in the drawings, and also comprises connecting portions 4*e*. When a force is applied to the arms 4*a* and 4*a'* in the direction indicated by arrow A, the bent portion 4*b* is projected in the direction B perpendicular to the direction A. In order to promote this projecting action, the arms 4*a* and 4*a'* are slightly folded with a certain angle on the bases thereof. A slider 5 comprises a pushbutton portion 5*a*, notches 5*b* to be engaged with the projections 1*g* formed on the case 1 and jaw portions 5*c* and 5*c'* formed on respective faces of the lower end of the push-button portion 5*a*. The length lc of the notches 5*b* is larger than the length lp of the projections 1*g*, so that the slider 5 moves in an out along a length (lc-lp) within the concave portion 1*a* of the case 1. A movable contact piece 6 constituting a movable contact of a second switch portion is integrally formed from a thin, electrically conductive metal plate high in resiliency. The movable contact piece 6 comprises arms 6*a* and 6*a'* formed on respective ends of the movable contact piece 6 and a reversing portion 6*b* held between both the arms 6*a* and 6*a'*. A part of the reversing portion 6*b* is punched and the reversing portion 6*b* comprises a movable contact portion 6*d* divided in a plurality of segments and having tongue pieces 6*c* formed by bending the contact portion 6*d* in the direction C in the drawings and also comprises connecting portions 6*e*. When a force is given by the arms 6*a* and 6*a'* in the direction indicated by arrow A, the reversing portion 6*b* is reversed and projected in the direction C. In order to promote this reversing action, the arms 6*a* and 6*a'* are slightly folded with a certain angle on the bases thereof. A second case 7 constituting a switch case in combination with the above-mentioned first case 1, which has a substantially channel shape, comprises a concave portion 7*a*, projections 7*b* and holes 7*c* corresponding to the concave portion 1*a*, projections 1*g* and poles 1*f* of the first case 1. Fixed contact portions 8*a* and 9*a* are exposed to a bottom 7*d* of the concave portion 7*a* and as in the first case 1, fixed contact pieces 8 and 9 having external connection terminals 8*b* and 9*b* are integrally formed by insert-molding.

Assembling of the push-button switch of the present invention will now be described. One arm 4*a* of the movable contact piece 4 forming the first switch portion is engaged with and fitted in the groove 1*d* formed on the side wall 1*c* of the first case 1. Then, the slider 5 is arranged in the opening 1*b* of the concave portion 1*a* of the case 1, and the other arm 4*a'* is engaged with the jaw portion 5*c* of the slider 5. One arm 6*a* of the movable contact piece 6 forming the second switch portion is engaged with and fitted in the other jaw portion 5*c'* of the slider. In this state, the slider 5 is slightly pushed in the direction pressing the movable contact pieces 4 and 6 to engage the notches 5*b* with the projections 1*g* of the case 1. The slider 5 is always urged upwardly by the spring forces of the movable contacts 4 and 6, and the central part of the mountain-shaped movable contact portion 4*d* of the movable contact piece 4 is brought into close contact with the surface 5*d* of the slider 5 and the slider 5 is pressed to the bottom surface 1*e* of the case 1 by the spring force of the movable contact piece 4. Accordingly, in this state, the respective elements are not disassembled fragmentarily. Then, the poles 1*f* of the case 1 are inserted into the holes 7*c* of the second case 7, and the case 7 is placed on the top face of the case 1, and both the cases are bonded and fixed by an adhesive or the like to complete assembling of the push-button switch of the present device, see FIG. 2.

The operations of the push-button switch of the present invention will now be described with reference to FIGS. 2 and 3.

In the state where the push-button portion 5*a* is not depressed as shown in FIGS. 2 and 3(*a*) since the movable contact pieces 4 and 6 are engaged with the grooves 1*d* and 1*d'* of the case 1 and the jaw portions 5*c* and 5*c'* of the slider 5, the slider 5 is urged upward (in the direction indicated by arrow D), the contact portions 4*d* and 6*d* of the movable contact pieces 4 and 6 of the first and second switch portions are kept in the non-contact state with the confronting fixed contact portions 2*a*, 3*a* and 8*a*, 9*a*.

When the push-button portion 5*a* is depressed in this state in the direction opposite to the direction of arrow D, that is, in the direction of arrow A, since the arms 4*a* and 4*a'* of the movable contact piece of the first switch portion are slightly folded with a certain angle on the bases thereof to promote bending and the reversing force of the movable contact piece 4 is smaller than that of the movable contact piece 6, the movable contact piece 4 is bent in the direction of arrow B and also the movable contact piece 6 of the second switch portion is bent in the direction of arrow C, see FIG. 3(*b*). When the push-button portion 5*a* is further depressed, bending of the movable contact piece 4 is increased, and the connecting portions 4*e* and movable contact portion 4*d* are reversed in a moment in the direction of arrow B. The respective tongue pieces 4*c* of the movable contact portion 4*d* are pressed by the repulsive force of the fixed contact portions 2*a* and 3*a* to produce the switch-on state, see FIG. 3(*b*).

When the push-button portion 5*a* is further depressed in this state, as shown in FIG. 3(*c*), also the movable contact piece 6 is reversed and the movable contact portion 4*d* is projected in the direction of arrow C, and while the tongue pieces 4*c* and 6*c* of the movable contact portions 4*d* and 6*d* are pressed to the fixed contact portions 2*a*, 3*a* and 8*a*, 9*a*, the slider 5 is caused to slide with deformation until the resiliency of the tongue pieces 4*c* and 6*c* are restricted. The moving region of the slider can be adjusted by appropriately changing the length lc of the notches 5*b* and the length lp of the projections 1*g*. When the pressing force is released in the state where the push-button portion 5*a* is pressed to the last extremity, the state shown in FIG. 3(*a*) is restored to produce the switch-off state.

According to the present invention, the first switch portion and second switch portions are arranged in parallel, the respective contact pieces are integrally molded from a thin, electrically conductive metal plate high in resiliency to form two movable contact pieces of bent springs differing in the reversing force and the switching operation is accomplished by the contact pieces of said reversing springs. Accordingly, the switching operation can be performed by a small depressing force with a very light switching touch. Furthermore, if there is provided a time difference between the reversing operations of the two reversing springs, two-motion changeover becomes possible. Therefore, the present invention provides a push-button switch of a simple structure which can be utilized in various fields.

What is claimed is:

1. A push button switch comprising first and second switch portions mounted in a case; each switch portion including a respective movable contact piece formed of a resilient metal plate having a reversing portion adapted to change its position suddenly upon application of a pressing force different that the pressing force needed to change the position of the reversing portion of the other movable contact, a respective movable contact portion, and arms formed to hold the reversing portion therebetween; fixed contact portions formed in the case at a position confronting each respective movable contact portion, and means including a single slider engaging each of said contact pieces for applying said respective pressing forces to change the position of the respective reversing portions so that the first and second switch portions may be actuated at different times by a single actuation of said slider.

2. A push-button switch as set forth in claim 1, wherein the movable contact piece comprises a pair of arms connected by a pair of bent portions and a reversing portion formed between the bent portions.

3. A push-button switch as set forth in claim 1, wherein grooves are formed at positions confronting the slider and case and the arms of the movable contact pieces are engaged with said grooves, respectively.

* * * * *